United States Patent [19]

Burnham et al.

[11] Patent Number: 4,521,890

[45] Date of Patent: Jun. 4, 1985

[54] PLASMA ARC FURNACES

[75] Inventors: Robert F. Burnham, Reading; Alan Gibbon, Near Reading; John E. Harry, Near Oakham, all of England

[73] Assignee: Johnson Matthey Public Limited Company, London, England

[21] Appl. No.: 498,114

[22] Filed: May 25, 1983

[30] Foreign Application Priority Data

May 25, 1982 [GB] United Kingdom ..... 8215192

[51] Int. Cl.[3] ..... H05B 7/00

[52] U.S. Cl. ..... 373/22

[58] Field of Search ..... 373/18, 22, 23, 24, 373/25, 102, 104, 107, 108; 219/121 P, 121 PA, 121 PT, 121 PV

[56] References Cited

U.S. PATENT DOCUMENTS 4,414,672 11/1983 Paton et al. ..... 373/22

FOREIGN PATENT DOCUMENTS 415310 2/1974 U.S.S.R. ..... 373/107

*Primary Examiner*—Reinhard J. Eisenzopf

*Attorney, Agent, or Firm*—Cushman, Darby & Cushman

[57] ABSTRACT

This invention relates to the construction and use of plasma arc furnaces; more particularly it relates to a transferred arc mode of operation in such furnaces. In more detail a plasma arc furnace according to this invention comprises at least two stationary plasma torches positioned at or near the upper end of a furnace chamber and directed downwardly at an inclined angle towards an electrically conducting vessel for containing melt produced in the furnace and at least one electrical return anode connection made to said vessel at a point above the point of coalescence of the arcs produced, in use, by the torches.

3 Claims, 6 Drawing Figures

PLASMA ARC FURNACES

Figure 1:
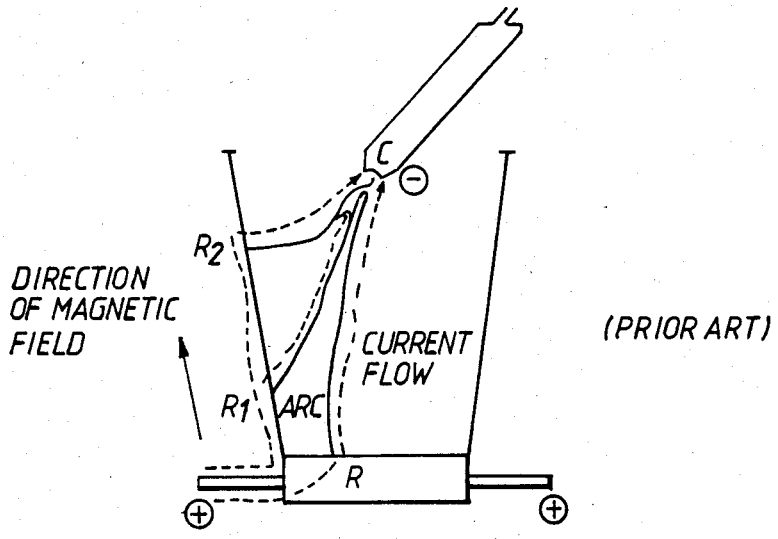

This invention relates to the construction and use of plasma arc furnaces; more particularly it relates to a transferred arc mode of operation in such furnaces.

Plasma arc furnaces are known to be useful for pyrometallurgical operations where relatively high temperatures need to be imparted to a solid feed material, for example, for refining or recovery of a metallic constituent. UK patent application GB No. 2,067,599 A, describes the recovery of platinum group metals from aluminium silicate containing substrates and suggest that charge temperatures greater than 1420° C. are required and even up to 1750° C. may be necessary.

Recovery according to GB No. 2,067,599 A, is particularly suitable for recovering platinum group metals from spent catalysts used in the purification of automobile exhaust gases. Such catalysts are frequency referred to as "autocatalyst" monolith, for brevity.

Known plasma reactors have utilized a plasma torch (sometimes referred to as a plasma gun) at the upper end of a reaction chamber and means for circulating or revolving the torch about or around the vertical axis of the chamber and above a stationary annular counter-electrode. With sufficiently high rates of revolution of the torch an extended cylindrical or an upright, conically-shaped plasma arc may be produced. (see for example U.S. Pat. No. 3,783,167).

We have now found that problems of arc stability and furnace capacity associated with prior art systems may be overcome and that for refining applications recovery can be improved.

According to one aspect of the present invention a plasma arc furnace comprises two or more stationary plasma torches positioned at or near the upper end of a furnace chamber and directed downwards at an inclined angle towards an electrically conducting vessel for containing the melt produced and at least one electrical return anode connection made to the said vessel at a level above the point of coalescence of the arcs produced by the said torches.

In a preferred embodiment of the invention three stationary plasma torches are spaced at 120° C. intervals around the top of the furnace chamber and inclined inwardly at an angle such that they are aimed at a central position at the base of the electrically conducting vessel used for containing the melt produced. Other embodiments of this invention may be constructed to give equivalent or better performance containing a larger number of torches. For example six torches may be used placed at 60° intervals around the top of the furnace chamber. However, for reasons of convenience and simplicity there follows a detailed description of a working furnace utilizing three torches. In operation the three torches powered by a single inductance stabilized power supply (80 KW) produce three transferred plasma arcs which coalesce to form a stable inverted cone of plasma. The conducting crucible or the melt itself contained in the conducting crucible provides the anode and each torch is a cathode. In the operation of this invention stabilization of the expanded transferred arc into which three individual arcs coalesce is achieved by inductance and current control independently for each torch and symmetrical arrangement of the torches. Stabilization of the arc is also enhanced by the positioning of the electrical return anode connections. Where three torches are used three individual arcs coalesce to form the inverted cone and we have found that operational stability of the plasma is greatly enhanced, even at high feed rates, when the electrical return anode connections are made at a level above the point at which arc coalescence occurs. In contrast with prior art furnaces, the present invention produces an inverted cone of plasma in which the apex of the cone, which is the arc coalescence point, is in contact with the electrically conducting crucible or melt contained therein. Preferably the electrical return anode connections are made at a level above the highest point at which coalescence occurs.

The optimum position for engineering convenience has been found to be at the top of the electrically conducting crucible forming the vessel containing the melt and the roof of the furnace chamber.

Figure 2:
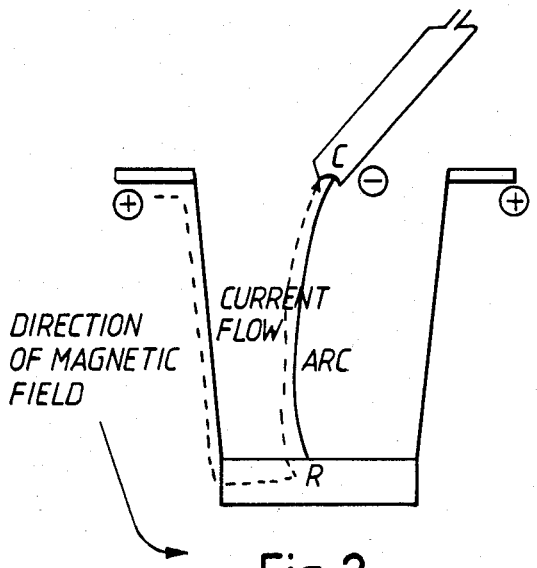

Whilst not wishing to be bound by any theoretical explanation for the improvement demonstrated by the invention, FIGS. 1 and 2 show in schematic form the electrical connections for a prior art plasma (FIG. 1) and for a plasma according to the present invention (FIG. 2). In accepting the convention that current flows from anode to cathode we have observed in prior art furnaces (FIG. 1) that the magnetic field generated in the anode has a destabilizing effect upon the arc and produces the need for two electrodes. If the root of the arc, R, moves away from the bottom of the crucible to the side the resulting magnetic field will tend to pull the plasma arc further up the side of the crucible to the positions $R_1$ and $R_2$. The arc will only return to the base position R when the electro-dynamics of the arc make it unstable and CR again becomes the preferred arc path. In FIG. 2 top anode connections are shown. The (conventional) current flow is towards the base of the crucible and the direction of pull of the magnetic field is reversed. This maintains a stable arc root R at the bottom of the crucible or in contact with the melt contained there.

Figure 3:
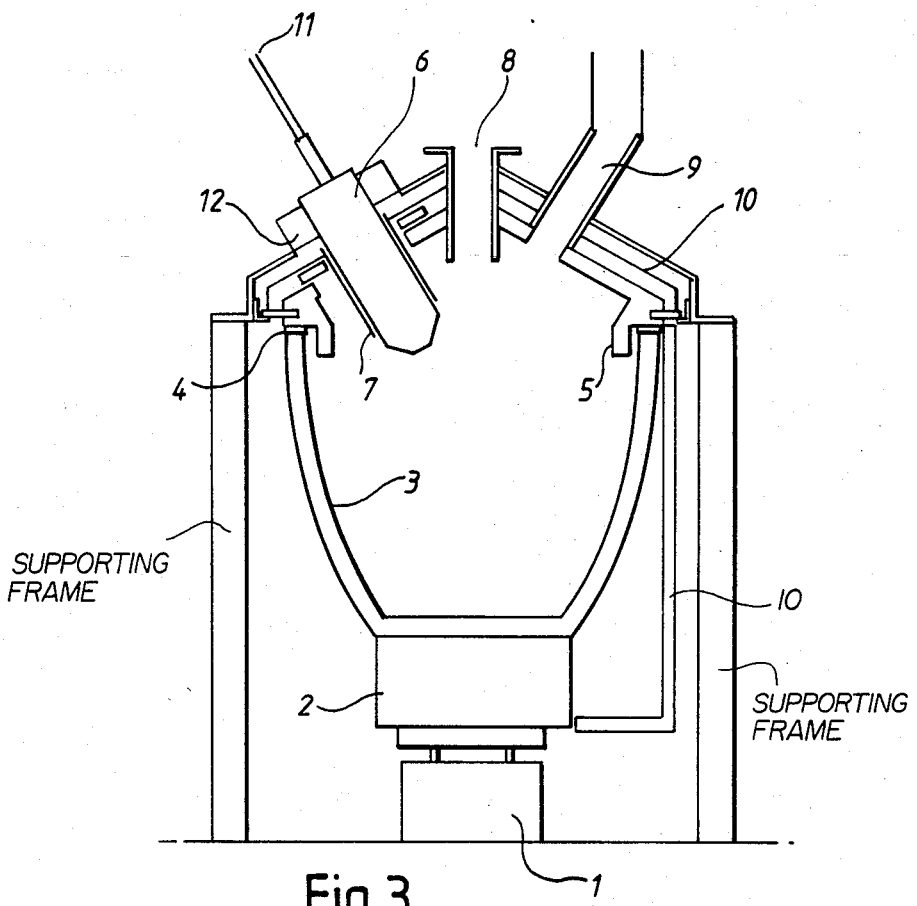

In FIG. 3 is depicted a vertical cross section through a practical furnace according to the present invention at a position which bisects one of the three Arcos (Registered Trade Mark) plasma torches which are housed in the roof of the furnace. In the figure components indicated by the numerals are:

1. Hydraulic jack
2. Insulating refractory support
3. Electrically conducting crucible
4. Water cooled copper anode
5. Graphite head-plate incorporating anode protection ring
6. Plasma torch
7. Insulating sheath for torch
8. Solid feed inlet
9. Exhaust (with sight glass not shown)
10. Low thermal mass insulating refractory
11. Torch services (including inert gas, coolant and power)
12. Torch support.

Electrically conducting crucible 3 is made of graphite or a carbon-containing refractory. The furnace head-plate 5 is made of a similar material. The guide-ring component of the head-plate 5 protects the hollow water-cooled annular copper anode 4 by preventing contact with molten slag. The torches are electrically isolated from each other and from the furnace shell. The torches are water-cooled and each one has a separate heat-exchanger through which deionised water is recycled. All exposed refractories are graphite or carbon based.

In operation a furnace according to the present invention has a number of advantages. Prior art anode take-offs at the base of the crucible would require water-cooling and thus reduce the temperature of the crucible and its contents. Since viscosity is in part a function of temperature it is an advantage to have as high a temperature as possible in the crucible giving improved separation of slag and collector metal phases and recovery of precious metal (for example) in the collector phase. Improved recovery is obtained with the higher temperature when the crucible is supported on an insulating refractory thus retaining the heat.

In furnaces according to the present invention solid feed passing through the arc increases the ionization potential of the arc path which is automatically compensated for by an increase of power within the arc. Substantial pre-heating or melting of the charge occurs. At the design throughput of the furnace extremely rapid melting of the charge can be achieved. The enhanced stability of the plasma arc in a furnace according to the present invention greatly facilitates the throughput of the large quantities of spent catalysts which are now becoming available.

We have obtained satisfactory melting of feed with a throughput of 0.5 kilo per minute.

Anode take-off at the top of the crucible enables the base of the crucible to be re-designed. If slag and collector metal phases are separately but continuously or intermittently removed, e.g. by weir devices, whilst the furnace is running it enables continuous or semi-continuous operation of the furnace to be achieved.

Figure 4:
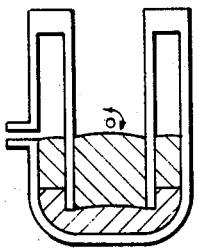
Figure 5:
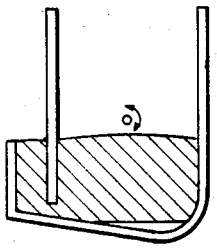

Examples of designs for continuous or semi-continuous operation are shown in FIGS. 4 and 5. Designs in FIGS. 4 and 5 enable the slag to be removed intermittently by tilting the crucible in the direction of the upper arrow. Alternative weir arrangements for continuous removal of both slag and collector metal phases are, of course, possible.

Figure 6:
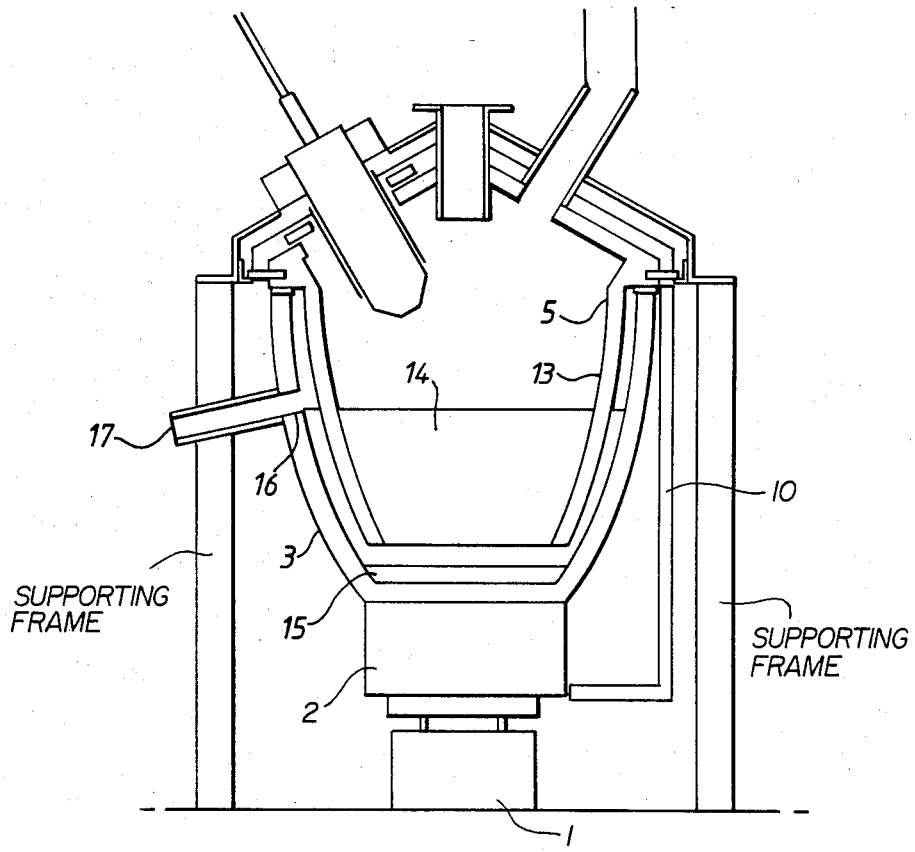

FIG. 6 shows an alternative embodiment of a practical furnace described in relation to FIG. 3 above. In FIG. 6 anode protection ring 5 forming part of the graphite head-plate is extended to form an annular slag baffle 13. The slag and metal collector phases 14 and 15 are shown. Weir 16 formed as an orifice in electrically conducting crucible 3 enables molten slag from the bottom of the melt to be discharged at exit 17 during continuous operation of the furnace.

SMELTING TRIALS

EXAMPLES 1 TO 6

Crushed "autocatalyst" monolith having approximate compositions as set out in samples 1 and 2 below were then selected for smelting trials. Approximately 80 KG of samples 1 and 2 were sampled using a Microscal SR40 and a SR1 spinning riffle. Chemical analyses of samples 1 and 2 were:

| | Sample 1 | Sample 2 |
|---|---|---|
| Pt | 0.095% | 0.095% |
| Pd | 0.054 | 0.054 |
| CaO | 0.6 | 0.6 |
| MgO | 10.7 | 10.8 |
| $SiO_2$ | 44.4 | 44.6 |
| $Al_2O_3$ | 41.1 | 41.1 |

In order to further increase the power output from the supply the air-cored inductors were tapped at 5 turn intervals between 110 and 75 turns. A high/low power switch was installed with the low power setting at 110 turns. A series of six smelting trials was carried out, using non-representative samples of "autocatalyst" in order to determine the optimum high power setting for the short crucible. A standard flux addition of 10 wt % CaO (as calcium hydroxide) and 10 wt % iron turnings was used in runs 20, 22, 25, 27, 30 and 36. The smelting operation proceeds as follows: the furnace was pre-heated for 5–10 minutes on the low power setting before the feed was introduced. After 5–10 minutes at a slow feed rate the power switch was turned to the high setting and the feed rate increased to the maximum consistent with the satisfactory operation of three transferred arcs. Any further increase in feed rate caused instability such that one or more of the arcs was extinguished. The operation conditions are given in Table 1 and the results and slag analyses in Table 2. Separations achieved ranging up to 90% recovery are considered satisfactory for non-optimised experiments.

TABLE 1

| | | | Operating Conditions | | | | | | |
|---|---|---|---|---|---|---|---|---|---|
| | | | SMELTING | | | | | | |
| | | Max Feed | Low Setting | | High Setting | | EQUILIBRATION | | No of turns on |
| Example No. | Run | Rate (g/min) | Power (kw) | Time (mins) | Power (kw) | Time (mins) | Power (kw) | Time (mins) | Inductance for High Power |
| 1 | 20 | 300 | 61 | 11 | 68 | 15 | 30 | 3 | 105 |
| 2 | 22 | 270 | 60 | 10 | 70 | 11 | 34.5 | 5 | 95 |
| 3 | 25 | 290 | 41 | 7 | 71 | 16 | 40 | 10 | 90 |
| 4 | 27 | 320 | 55 | 10 | 74 | 16 | 44 | 15 | 85 |
| 5 | 30 | 380 | 41 | 10 | 74 | 16 | 36 | 7 | 85 |
| 6 | 36 | 370 | 47 | 10 | 80 | 16 | 43 | 7 | 85 |

TABLE 2

| | | | | Results and Slag Analyses | | | | | | |
|---|---|---|---|---|---|---|---|---|---|---|
| Example No. | Run No. | Wt of Autocat g | Wt of Lime g | Wt of Iron turnings g | Wt of Iron starter g | Wt of Slag g | Mag Sep Slag g | Wt of Iron g | SLAG ANALYSIS Pt % | Pd % |
| 1 | 20 | 3092 | 408 | 309 | 223 | 3271 | — | 500 | 0.054 | 0.025 |
| 2 | 22 | 3059 | 404 | 306 | 221 | 3400 | 30 | 581.5 | 0.018 | 0.009 |
| 3 | 25 | 3986 | 526 | 398 | 211 | 4074 | 45.6 | 631 | 0.017 | 0.008 |
| 4 | 27 | 4000 | 600 | 400 | 210 | 4289 | 61.1 | 629 | 0.010 | 0.005 |
| 5 | 30 | 4000 | 600 | 1500 | 250 | 4455 | 23.0 | 1718 | 0.009 | 0.004 |

TABLE 2-continued

| Results and Slag Analyses | | | | | | | | | | |
|---|---|---|---|---|---|---|---|---|---|---|
| Example No. | Run No. | Wt of Autocat g | Wt of Lime g | Wt of Iron turnings g | Wt of Iron starter g | Wt of Slag g | Mag Sep Slag g | Wt of Iron g | SLAG ANALYSIS Pt % | Pd % |
| 6 | 36 | 4647 | 613 | 465 | — | 5300 | 4.3 | 796 | 0.008 | 0.003 |

EXAMPLE 7

A crushed "autocatalyst" monolith used in this example contained 0.105% Pt and 0.013% Pd. The furnace charge comprised "autocat" (4.78 Kg), lime (0.63 Kg)—equivalent to 10 wt % CaO addition, and iron oxide (0.34 Kg)—equivalent to 5 wt % iron addition. The mix was continuously fed into a furnace according to the present invention and a maximum feed rate of approximately 500 g/min was achieved with a power consumption of 2800 Kwh/tonne. The maximum recorded melt temperature was 1540° C.; after 10 minutes equilibration, the melt temperature was 1480° C. These temperatures were measured by a 13% Rh/Pt thermocouple embedded in the crucible below the melt level.

After cooling, the products were removed from the Suprex (R-T-M) crucible and the iron button (0.29 Kg) was easily separated from the glassy slag (5.15 Kg). A representative sample of the slag contained 0.0011% Pt; Pd was not detected (i.e. <1 p.p.m). This represents a 98.9% Pt recovery and approximately 100% Pd recovery by weight.

A complete analysis the the "autocatalyst" was as follows:

| | Pt % | Pd % | $Al_2O_3$ % | $SiO_2$ % | MgO % | CaO % |
|---|---|---|---|---|---|---|
| Autocatalyst Monolith | 0.105 | 0.013 | 41.1 | 44.4 | 10.7 | 0.6 |

EXAMPLE 8

A charge comprising the crushed "autocatalyst" monolith as in Example 7 (4.20 Kg), lime (0.56 Kg)—equivalent to 10 wt % CaO addition, iron oxide (0.30 Kg)—equivalent to 5 wt % Fe addition and the stoichiometric carbon addition (0.07 Kg) for the reduction of $Fe_2O_3$ to Fe was continuously fed into a furnace according to the present invention.

The maximum feed rate achieved was 450 g/min with a related power consumption of 2900 Kwh/tonne. The maximum recorded melt temperature was 1610° C. which fell to 1560° C. after 10 minutes equilibration.

After cooling the products were removed from the Suprex crucible and the iron button (0.25 Kg) separated from the dark glassy slag (4.31 Kg). The chemical analysis, platinum group metal mass balances and platinum group metal recoveries are as follows:

| PRODUCT | Pt % | Pd % | $Al_2O_3$ % | $SiO_2$ % | MgO % | CaO % | FeO % |
|---|---|---|---|---|---|---|---|
| SLAG | 0.001 | ND | 35.5 | 42.9 | 9.8 | 7.9 | 0.7 |

| PRODUCT | Pt % | Pd % | Fe % | SI % | TI % | NI % |
|---|---|---|---|---|---|---|
| Fe BULLION | 1.741 | 0.242 | 79.5 | 16.1 | 0.4 | 0.2 |

| | Pt % | Pd % |
|---|---|---|
| RECOVERY INTO BULLION* | 99.0 | 99 |
| (LOSS)/ GAIN | (<1) | 11 |

ND (Not Detectable) - <0.0001%
*Based on product assays.

EXAMPLE 9

A charge comprising the crushed "autocatalyst" monolith used in example 1 (4.70 Kg), lime (0.63 Kg)—equivalent to 10 w% addition of CaO and iron turnings (0.24 Kg) was continuously fed to a furnace according to the present invention. The maximum feed rate achieved was 450 g/min with a related power consumption of 2900 Kwh/tonne. The maximum recorded melt temperature was 1615° C. which fell to 1590° C. after 10 minutes equilibration.

After cooling the products were removed from the Suprex crucible and the iron button (0.33 Kg) separated from the glassy slag (5.04 Kg). The chemical analyses, platinum group metal mass balances and platinum group metal recoveries are as follows:

| PRODUCT | Pt % | Pd % | $Al_2O_3$ % | $SiO_2$ % | MgO % | CaO % | FeO % |
|---|---|---|---|---|---|---|---|
| SLAG | 0.003 | 0.001 | 35.3 | 41.6 | 9.6 | 8.1 | 0.4 |

| PRODUCT | Pt % | Pd % | Fe % | SI % | TI % | NI % |
|---|---|---|---|---|---|---|
| Fe BULLION | 1.32 | 0.17 | 9.7 | 12.9 | 0.3 | 0.2 |

| | Pt % | Pd % |
|---|---|---|
| RECOVERY INTO BULLION* | 96.6 | 91.8 |
| (LOSS)/ GAIN | (8.7) | <1 |

*Based on product assays.

EXAMPLE 10

A charge comprising the crushed "autocatalyst" monolith used in example 7 (4.85 Kg) and lime (0.64 Kg)—equivalent to 10 wt % addition of CaO was continuously fed to a furnace according to the present invention. The maximum feed rate achieved was 450 g/min with a related power consumption of 2900 Kwh/tonne. The maximum recorded melt temperature was 1585° C. When all the charge was in iron turnings (0.24 Kg) was fed into the furnace in about 2 minutes. The melt was allowed to equilibrate for 10 minutes; the final temperature was 1535° C.

After cooling the iron button (0.30 Kg) was separated from the slag (4.95 Kg) the chemical analyses, PGM recoveries are as follows:

| PRODUCT | Pt % | Pd % | $Al_2O_3$ % | $SiO_2$ % | MgO % | CaO % | FeO % |
|---|---|---|---|---|---|---|---|
| SLAG | 0.002 | 0.001 | 35.8 | 41.4 | 9.9 | 8.2 | 0.5 |

| PRODUCT | Pt % | Pd % | Fe % | SI % | TI % | NI % |
|---|---|---|---|---|---|---|
| Fe BULLION | 1.30 | 0.16 | 86.9 | 6.9 | 0.1 | 0.2 |

| | Pt % | Pd % |
|---|---|---|
| RECOVERY INTO BULLION* | 97.5 | 90.6 |
| (LOSS)/ GAIN | (21.4) | (15.9) |

*Based on product assays.

EXAMPLE 11

A charge comprising a non-representative sample of the crushed "autocatalyst" monolith used in example 7 (11.5 Kg), lime (1.52 Kg)—equivalent to 10 wt % CaO addition, iron oxide (0.82 Kg) and carbon powder (0.19 Kg)—equivalent to approximately 5 wt % Fe addition was continuously fed to a furnace according to the present invention. The maximum feed rate achieved was 525 g/min with a related powder consumption of 2500 Kwh/tonne. The maximum recorded melt temperature was 1535° C. which fell to 1515° C. after 10 minutes equilibration.

After cooling the iron button (0.65 Kg) was separated from the slag (11.40 Kg). The slag contained <0.001% Pt; Pd was not detected. The overall recoveries were >99%

EXAMPLE 12

"Autocatalyst" pellets used in this example were of 5 mm equivalent diameter alumina spheres and cylinders. They contained 0.036% Pt and 0.015% Pt, the balance was assumed to be $Al_2O_3$. A furnace according to the present invention was charged with pellets (5.00 Kg), crushed marble chips (8.9 Kg)—equivalent to 100 wt % addition of CaO and iron oxide (0.38 Kg) and carbon powder (0.08 Kg)—equivalent to 5 wt % Fe addition. The mix was continuously fed to the furnace according to the invention and a maximum feed rate of approximately 500 g/min was achieved with a related power consumption of 3000 Kwh/tonne. The maximum recorded melt temperature was 1655° C. which fell to 1500° C. after 10 minutes equilibration.

After cooling the iron (0.21 Kg) and slag (10.6 Kg) were separated. The chemical anlyses, platinum group metal mass balance and platinum group metal recoveries are given below.

| | Pt % | Pd % | Fe % |
|---|---|---|---|
| SLAG | 0.0006 | ND | — |
| BULLION | 0.667 | 0.257 | 88.23 |

| | Pt % | Pd % |
|---|---|---|
| RECOVERY INTO BULLION* | 95.6 | ND |
| (LOSS)/ GAIN | (19) | (23) |

*Based on product analyses
ND (Not Detectable) <0.0001% Pd in slag.

EXAMPLE 13

A different alumina based catalyst, namely, a reforming catalyst material was used comprising 2–3 mm spheres and containing 0.5% Pt was treated in a similar way. The furnace charge consisted of alumina feed (2.00 Kg), crushed marble chips (3.60 Kg)—equivalent to 100 wt % CaO addition and iron oxide (0.30 Kg) and carbon powder (0.06 Kg)—equivalent to 10 wt % Fe addition. The mix was continuously fed to a furnace according to the present invention and a maximum feed rate of 300 g/min was achieved with a related power consumption of 4000 Kwh/tonne. The maximum recorded melt temperature was 1625° C. which fell to 1565° C. after 10 minutes equilibration. After cooling the iron (0.16 Kg) and slag (4.15 Kg) were separated. The iron was hard and difficult to crush. A representative sample of slag contained 0.002% Pt equivalent to >99-% recovery.

EXAMPLE 14

Crushed "autocatalyst" monolith containing approximately 0.08% Pt and 0.04% Pd and a copper collector were used in this example. The charge comprised "autocatalyst" (5.00 Kg), lime (0.66 Kg)—equivalent to 10 wt % CaO addition and copper powder (0.025 Kg). The mix was continuously fed to the furnace and a maximum feed rate of 500 g/min was achieved with a related power consumption of 2600 Kwh/tonne. The maximum recorded melt temperature was 1560° C. which fell to 1430° C. after 10 minutes equilibration.

After cooling the copper bullion (0.24 Kg) and the slag (5.6 Kg) were separated. The chemical analyses, mass balances and platinum group metal recoveries are given below.

| PRODUCT | Pt % | Pd % |
|---|---|---|
| SLAG | 0.009 | 0.005 |

| PRODUCT | Pt % | Pd % | Cu % | Fe % | SI % |
|---|---|---|---|---|---|
| BULLION | 1.44 | 0.63 | 75.0 | 9.6 | 9.4 |

| | Pt % | Pd % |
|---|---|---|
| RECOVERY INTO BULLION* | 87.5 | 83.3 |
| (LOSS)/ GAIN | <1 | (12) |

*Based on product assays.

EXAMPLE 15

An alumino-silicate molecular sieve material comprising small 'twigs' and containing 0.3% Pt 66% $510_2$ and 24% $Al_2O_3$ was treated as follows. The alumina-silicate feed (5.0 Kg), marble chips (2.0 Kg)—equivalent to 20 wt % addition and iron oxide (0.3 Kg) and carbon powder (0.08 Kg)—equivalent to 5 wt % Fe addition were continuously fed into the furnace according to the present invention at a maximum feed rate of 500 g/min. The maximum recorded melt temperature was 1550° C. which fell to 1470° C. after ten minutes equilibration. After cooling the bullion (0.33 Kg) and the slag (6.04 Kg) were separated. The chemical analyses and the platinum group metal recoveries are given below.

| PRODUCT | Pt % |
|---|---|
| BULLION | 4.51 |
| SLAG | 0.02 |

| | Pt % |
|---|---|
| RECOVERY INTO BULLION* | 92.5 |
| (LOSS)/ GAIN | 7 |

*Based on product assays.

In view of the high return demanded by customers, a high precious metal recovery is required from alumina containing materials if a commercially successful process is to be achieved. Conventional pyrometallurgy cannot achieve this aim.

The smelting of the above materials is 1250°–1300° C. can only be achieved by the addition of large amounts of fluxes. A sodium silicate slag could be used in order to achieve a low viscosity slag and hence maximise platinum group metal recovery into the bullion, however, the alumina content of the slag should not exceed 10%. Typical furnace charges for "autocatalyst" monoliths (approx 45% $Al_2O_3$) and pellets (approx 100% $Al_2O_3$) are given below. The figures in brackets are typical plasma smelt flux additions used in a furnace according to the present invention.

| | | |
|---|---|---|
| "Autocatalyst" Monolith | 1000 g | 1000 g |
| $Na_2SIO_3$ | 3000 g | (100 g) |
| Fe | 50 g | (50 g) |
| TOTAL | 4050 g | (1150 g) |
| "Autocatalyst" Pellets | 1000 g | (1000 g) |
| CaO | 1000 g | (1000 g) |
| $Na_2SIO_3$ | 8000 g | — |
| Fe | 50 g | (50 g) |
| TOTAL | 10050 g | (2050 g) |

It will, therefore, be appreciated from the above that a significantly larger capacity conventional smelting furnace is required than is the case using a plasma furnace according to the invention. Further, the capital repayments, cost of additional fluxes and energy to melt the charge in a conventional furnace result in a significantly more expensive process. Experience also suggests that the required recoveries will not be achieved due to the large weight ratio of slag to bullion. Slags containing 50 ppm Pt ("Autocatalyst" Monolith) and 20–30 ppm (pellets) are likely and indicate recoveries into the bullion of only 75% and <50% respectively.

Although the temperature required for smelting the above materials viz >1500° C. cannot be easily achieved by direct electric heating using either rods or elements, induction furnaces and conventional arc furnaces can achieve these temperatures. However, induction heating of the refractory material is difficult due to poor susceptibility and coupling with the crucible will be inefficient. It is likely that an arc furnace could be effectively used but it would be more expensive to operate due to electrode and refractory costs. Both would tend to stir the melt making operation of a continuous smelting process more difficult and most probably resulting in higher slag losses due to insufficient settling.

Furthermore, dust losses in a plasma furnace according to the invention are low—typically <2 wt % of the charge and equivalent to approximately 2 wt % of the values present. Typical analyses of flue dust are 0.12% Pt and 0.1% Pd.

We claim:

1. A plasma arc furnace in which solid feed material passes through the arcs produced by at least two stationary plasma torches positioned at or near the upper end of a furnace chamber and directed downwardly at an inclined angle towards an electrically conducting vessel for containing melt produced in the furnace and two or more electrical return anode connections made to said vessel at a level above the point of coalescence of the arcs produced, in use, by the said torches.

2. A furnace according to claim 1 in which the electrical return anode connection is made to said vessel at a level above the highest point of coalescence of the arcs produced.

3. A furnace according to claim 1 including three symmetrically positioned plasma torches.

* * * * *